US005562260A

United States Patent [19]

Salvador et al.

[11] Patent Number: 5,562,260

[45] Date of Patent: Oct. 8, 1996

[54] LINE EXTENSION AND RETRACTION MECHANISM

[76] Inventors: Wayne Salvador; Julie Salvador, both of 460 D. St., Fremont, Calif. 94536

[21] Appl. No.: 198,218

[22] Filed: Feb. 16, 1994

[51] Int. Cl.[6] ..... B65H 75/38

[52] U.S. Cl. ..... 242/397.1; 242/376

[58] Field of Search ..... 242/371, 376, 242/379, 397.1, 399, 400.1, 405.1, 405.2

[56] References Cited

U.S. PATENT DOCUMENTS

| | | | |
|---|---|---|---|
| 156,586 | 11/1874 | McNeill | 242/397.1 X |
| 569,128 | 10/1896 | Guild | 242/397.1 X |
| 1,659,160 | 2/1928 | Richards | 242/371 X |
| 1,977,692 | 10/1934 | Norling | 242/376 X |
| 2,626,763 | 1/1953 | Dunnock . | |
| 3,089,210 | 5/1963 | Ritter | 24/71.1 |
| 3,193,212 | 7/1965 | Lotta . | |
| 3,245,635 | 4/1966 | Signor . | |
| 4,014,478 | 3/1977 | Bonacina . | |
| 4,394,992 | 7/1983 | Föhl | 242/371 X |
| 4,458,856 | 7/1984 | Mansel-James . | |
| 4,826,099 | 5/1989 | Johnson . | |
| 4,993,128 | 2/1991 | Gold | 24/715.3 |
| 5,074,483 | 12/1991 | Wang | 242/76 |
| 5,184,864 | 2/1993 | Teigen et al. | 296/24.1 |
| 5,246,183 | 9/1993 | Leyden . | |

*Primary Examiner*—Daniel P. Stodola
*Assistant Examiner*—Emmanuel M. Marcelo
*Attorney, Agent, or Firm*—Bielen, Peterson & Lampe

[57] ABSTRACT

A line retraction and extension mechanism utilizing a housing having a chamber which possesses a predetermined dimension. The housing includes an entrance which leads to the chamber within. An elastomeric line is capable of passing into the chamber through the chamber entrance. A first end portion of the elastomeric line extends outwardly from the chamber while a second end portion of the elastomeric line is fixed relative to the chamber dimension. Internal structural elements in the chamber extend or store the elastomeric line to a predetermined degree to allow a large separation between the first end portion of the line and the housing when tension is applied between the housing and the first end portion of the line.

7 Claims, 2 Drawing Sheets

LINE EXTENSION AND RETRACTION MECHANISM

BACKGROUND OF THE INVENTION

The present invention relates to a novel line control mechanism.

Retractable reel and line mechanisms find a variety of uses by permitting the extension or retraction of items connected to a line. For example, reels and line combinations may be employed to operate shades, key chains, doors, measuring tapes, and the like.

In most cases, the reel associated with the line is spring loaded along its axis. For example, U.S. Pat. No. 5,246,183 shows a coil spring which is utilized in conjunction with a spool and a flexible cable.

U.S. Pat. Nos. 3,245,635, 4,014,478, and 4,826,099 teach twisted elastic members generally located along the axis of the reel to extend or retract a line on the reel.

U.S. Pat. No. 4,458,856 shows a drum having a main spring for rotating the drum to wind out or to wind in line.

U.S. Pat. No. 5,184,864 teaches a spring loaded drum to operate an articulated door.

U.S. Pat. Nos. 2,626,763 and 3,193,212 illustrate a close line drum which is also spring loaded to tighten the same.

U.S. Pat. No. 4,993,128 describes a stretchable cord which is placed around the wrist of the user to hold keys and the like.

U.S. Pat. No. 3,089,210 shows a cord holder which utilizes a box having a serpentine interior to store a cord.

A mechanism which metes line and is reliable and simple to manufacture would be a notable advance in the art of general accessories.

SUMMARY OF THE INVENTION

In accordance with the present invention, a novel and useful line extension and retraction mechanism is herein provided.

The mechanism of the present invention utilizes a housing having a chamber possessing a predetermined dimension. The housing may be of any shape and size. An entrance is also provided to the chamber from the external portion of the housing to said chamber.

An elastomeric line is also included in the present invention and is capable of passing into the chamber through the chamber entrance. The elastomeric line includes a first end portion which is fixed relative to the chamber dimension and a second end portion which extends outwardly from the chamber entrance. In certain cases, multiple elastomeric lines may be employed with a single housing having multiple entrances to the chamber. In the latter case, lines may be extended independently from the housing at various angles relative to one another. The outer wall portion of the housing may be formed of a flexible material to absorb impact and shock.

Extension means is also included in the present invention for guiding the elastomeric line along the dimension within the chamber. Such dimension may be a linear dimension and the extension means may include turning or bending the elastomeric line within the chamber to form a back and forth or zig-zag pattern. Such extension means may include at least one protuberance which contact the line and permits the line to be bent around the protuberance. The protuberance is located a selected distance from the chamber entrance to provide an extension of the line along the dimension of the chamber. In addition, another protuberance may be located in spaced configuration from the chamber entrance and in spaced location from the first protuberance. The line may be wrapped or turned about both protuberances in the chamber. The second end portion of the elastomeric line may terminate in a fixation point at the chamber wall. The fixation point may include passing the second end portion of the line through the wall of the housing and forming an enlargement to hold the same to the wall when tension is applied to the first end portion of the line. Extension means may also include construction of a spool within the chamber in order to permit the elastomeric line to wrap about the spool. The spool may include a knurled outer surface and rotate about an axle extending along the dimension of the chamber. The axle may be threaded or smooth as the case may be.

It may be apparent that a novel and useful line control mechanism has been described.

It is therefore an object of the present to provide a line control mechanism which is simple to construct and possesses advantages over spring loaded reels without the use of a spring.

It is another object of the present invention to provide a line control mechanism which may be formed in a housing having a flexible portion for use as a stop mechanism for a door.

Another object of the present invention is to provide a line control mechanism which is reliable and not susceptible to corrosion or low cycle life inherent in metallic springs.

A further object of the present invention is to provide a line control mechanism which includes an elastomeric line that is simple to replace when worn.

A further object of the present invention is to provide a line control mechanism which provides a longer line extension from a housing than a spring loaded reel.

Yet another object of the present invention is to provide a reel mechanism which is inherently lighter in weight than metallic spring loaded reel mechanisms.

Another object of the present invention is to provide a reel mechanism which generates a relatively even tension force on an elastomeric line during the egress of various lengths of line from a housing.

Another object of the present invention is to provide a reel mechanism which provides the feature multiple lines exiting from a single housing at various angles of orientation.

The invention possesses other objects and advantages especially as concerns particular characteristics and features thereof which will become apparent as the specification continues.

Figures 1, 2:
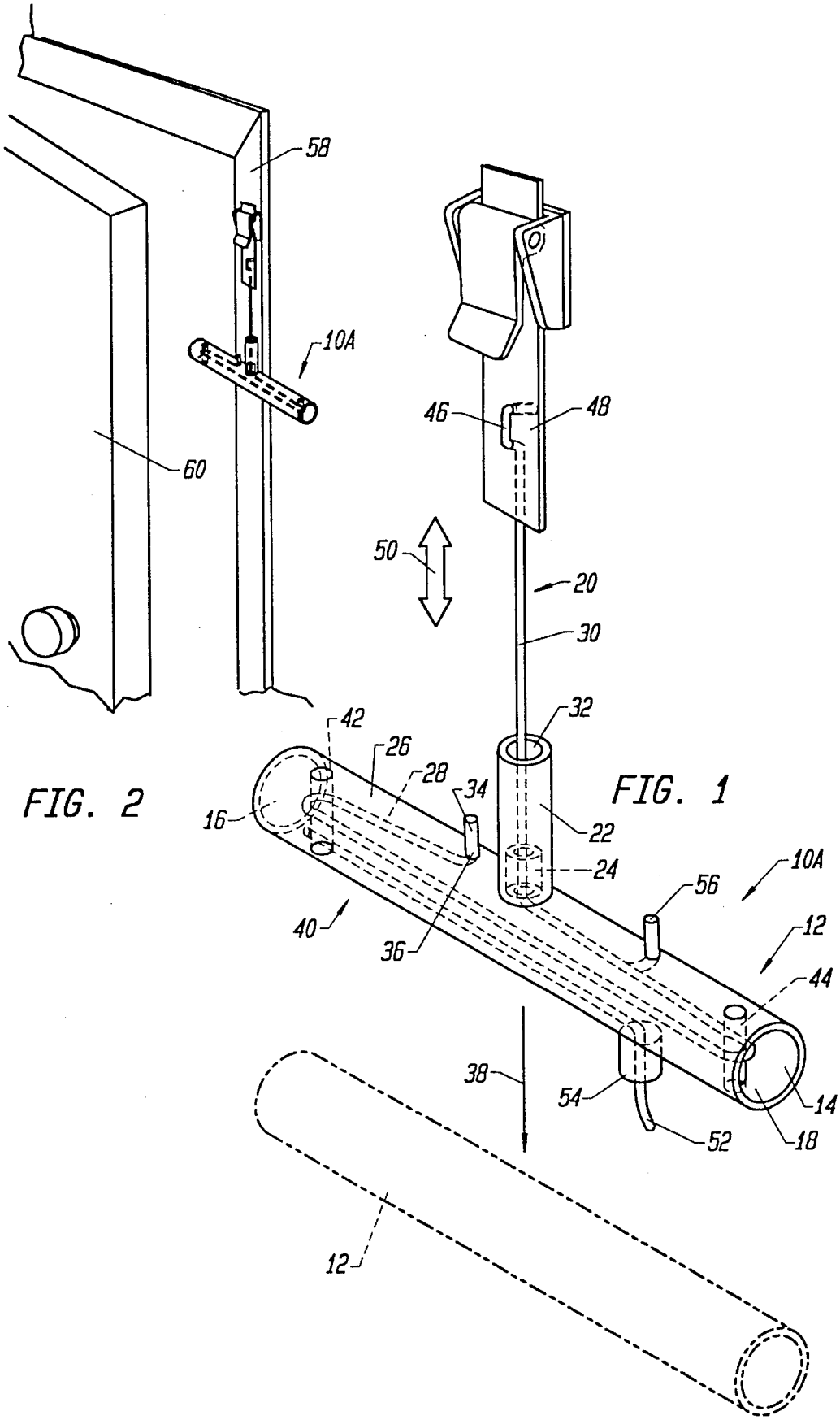
FIG. 1 a top right perspective view of the mechanism of the present invention held in place by a clip and being extended therefrom.
FIG. 2 is a perspective view depicting the reel mechanism of claim 1, having a single line extending therefrom in place on a door jamb.

Reference is made to following detailed description of the preferred embodiments which should be referenced to the prior described drawings.

DETAILED DESCRIPTION OF THE PREFERRED EMBODIMENTS

Various aspects of the present invention will evolve from the following detailed description of the preferred embodiments thereof which should be taken in conjunction with the herein before described drawings.

The invention as a whole is shown in the drawings by reference character 10 and an upper case letter depicting various embodiments of the same. Reel mechanism 10A, FIG. 1, includes as one of its elements a housing 12 which is shown as being cylindrical in shape and is formed of soft resilient material. Housing 12 includes open end portions 14 and 16. It should be noted that housing 12 may take any form including spherical, cubical, pyramidal, and the like. Housing 12 includes a chamber 18 which possesses a predetermined dimension that is capable of accommodating or storing elastomeric line 20. The particular dimension for the embodiment 10A, housing 12 would extend linearly along the altitude of the cylinder forming housing 12, between ends 14 and 16. Housing 12 includes an entrance in the form of hollow element 22 which fits over a hollow element 24 fastened to the outer surface 26 of housing 12.

Elastomeric line 20 possesses a first end portion 28 and a second end portion 30 which extends out of entrance 32 to chamber 18. Elastomeric line 20 includes an enlarged end 34 which lies on the outside of chamber 14 on surface 26. First end portion 28 extends through an opening 36 of housing 12, in this regard. Thus, enlargement 34 serves as a fixation point when elastomeric line 20 is tensioned according to directional arrow 38.

Extension means 40 is also illustrated in FIG. 1 and takes the form of protuberances 42 and 44 which are in the form of posts that are fixed to the housing 12 such that the outer ends of protuberances 42 and 44 lie flush with surface 26. Thus, elastomeric line 20 extends from enlarged end 34 around protuberances 42 and 44 and out through entrance 32. End 46 of second end portion 30 of elastomeric line 20 is held to a clip 48. Thus, line 20 travels from entrance 32 or back to entrance 32 according to directional arrow 50.

Second elastomeric line 52 may extend into entrance element 54 in a similar manner. That is to say, elastomeric line 52 may wrap around protuberances 42 and 44 and terminate in an enlarged end 56 in the same manner as enlarged end 34 of elastomeric line 20. Thus, multiple lines may extend from housing 12 each possessing an elastomeric characteristics. The user may pull housing 12 downwardly as depicted in phantom on FIG. 1

With reference to FIG. 2, it may seen that mechanism 10A may be placed on a door jamb 58 to intercept the swing of door 60 relative to the same, which will be detailed hereinafter. It should be noted, that the embodiment 10A shown in FIG. 2 lacks second elastomeric line 52.

Figure 5:
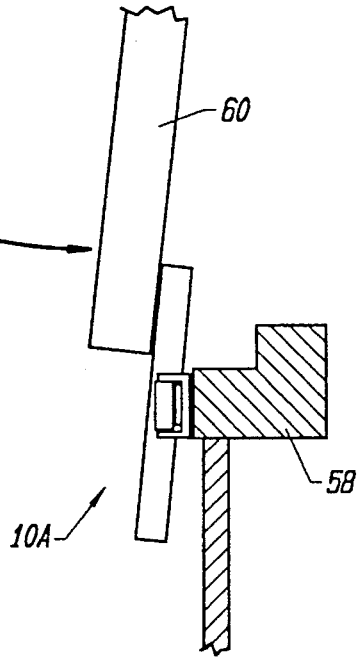
Figure 6:
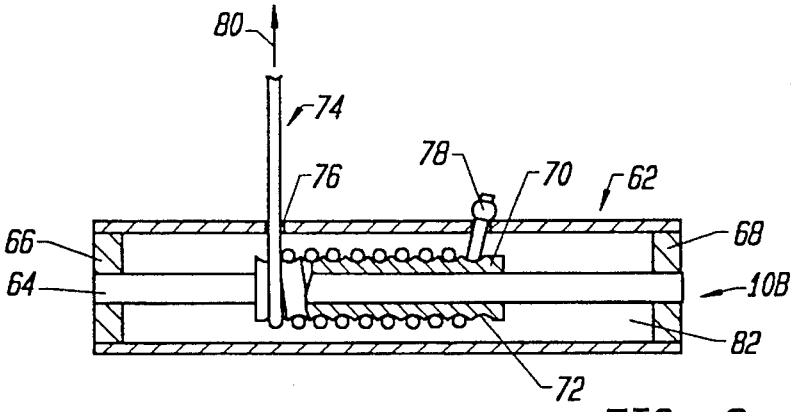
FIG. 6 is a sectional view of another embodiment of the present invention.

Turning now to FIG. 6, another embodiment 10B of the present invention is illustrated where a housing 62 of cylindrical shape is provided. Housing 62 may be formed of hard or soft material but includes an axle or rod 64 which spans closed ends 66 and 68 of housing 62. A spool 70 having an outer knurled surface 72 is free to rotate about axle 64. Elastomeric line 74 extends through entrance opening 76 in housing 62. Enlargement 78 fixes line 74 to housing 62. Directional arrow 80 indicates that tension may be applied to elastomeric line 74 causing elastomeric line 74 to unwind from rotatable spool 70 within chamber 82 of housing 62. Thus, extension means 40 in FIGS. 5, 6, and 7 guide line 74 along a spiral dimension in chamber 82.

Figure 7:
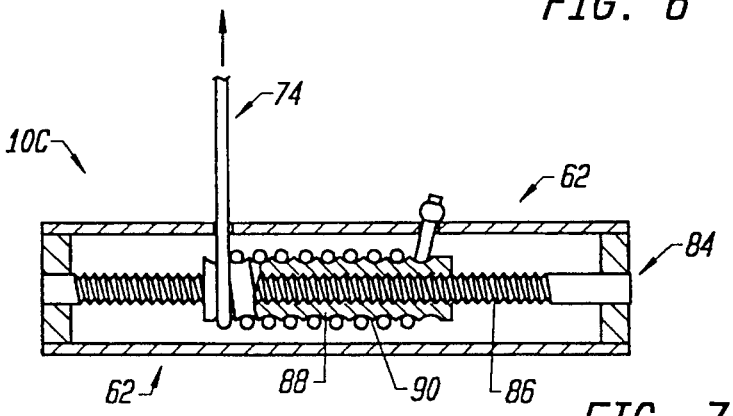
FIG. 7 is a sectional view of yet another embodiment of the present invention.

With reference to FIG. 7, embodiment 10C of the present invention is revealed. Embodiment 10C is similar to embodiment 10B accept that axle 84 extending along housing 62 includes a threaded portion 86. Spool 88 is provided with an internal threaded portion 90. Such spool 88 rotates according to the path of travel determined by threaded portions 86 and 90 of axle 84 and spool 88, respectively.

Figure 3:
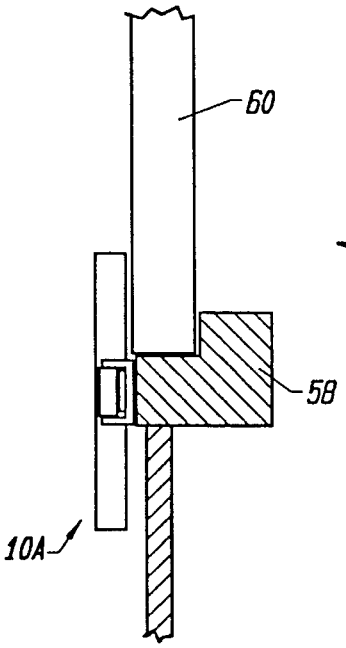
FIGS. 3–5 are top plan views representing the opening and closing action of the door depicted in FIG. 2 and the stopping function exhibited by the mechanism of the present invention.
Figure 4:
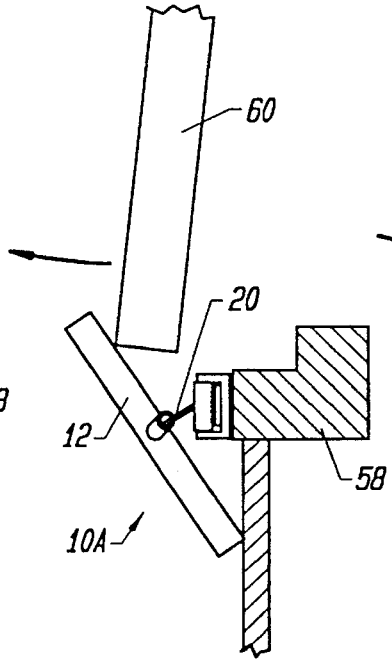

In operation, the user of embodiment 10A merely pulls elastomeric line 20 or 52 from housing 12. Elastomeric line will offer a relatively uniformed resistance to such pulling force and line 20 or 52 will be payed out for use. Release of the tension applied to elastomeric line 20 or 52 will result in retraction of those elastomeric lines into housing 12. Turning to FIGS. 3, 4, and 5, it may be observed that embodiment 10A may be employed as a stop mechanism for a door since elastomeric line 20 tends to spring housing 12 into the position shown in FIG. 3 to interrupt of closing door 60, FIG. 5. FIGS. 6 and 7 represent spool structures that may be used in place of the double post structures shown in FIG. 1 as extension means 40, to permit the unwinding and retraction of elastomeric line 74 from housing 62.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. An extension and retraction mechanism comprising:

a. a housing including a chamber possessing a predetermined dimension, said housing including an entrance thereto;

b. an elastomeric line passing into said chamber through said chamber entrance,said elastomeric line including a first end portion being fixed relative to said housing chamber and a second end portion extending within said chamber and outwardly from said chamber entrance; and c. extension means for guiding the extending of said elastomeric line within said chamber and along said dimension of said chamber, said extension means including a protuberance within said chamber,said protuberance contacting said elastomeric line and bending said elastomeric line,said protuberance being located within said housing chamber at a selected distance from said chamber entrance along said chamber diminsion.

2. The reel mechanism of claim 1 in which said extension means includes a pair of protuberances located within said housing chamber, each protuberance spaced from said chamber entrance and from each other along said dimension of said chamber, each protuberance contacting said elastomeric line to permit bending of said elastomeric line.

3. The reel mechanism of claim 2 in which said dimension of said chamber is a linear dimension.

4. The reel mechanism of claim 1 in which said housing includes a flexible outer wall portion.

5. The reel mechanism of claim 1 in which said extension means includes a spool rotatable within said chamber said elastomeric line wrapping about said spool.

6. The reel mechanism of claim 5 in which said spool includes a knurled outer surface.

7. The reel mechanism of claim 6 in which said spool rotates about a threaded rod extending along said dimension of said chamber.

* * * * *